US005155884A

United States Patent [19]

Moore

[11] Patent Number: 5,155,884

[45] Date of Patent: * Oct. 20, 1992

[54] DUST MOP WITH BUMPER

[76] Inventor: Terry D. Moore, 2415 Hinton Rd., Dacula, Ga. 30211

[ * ] Notice: The portion of the term of this patent subsequent to Feb. 5, 2008 has been disclaimed.

[21] Appl. No.: 641,285

[22] Filed: Jan. 15, 1991

Related U.S. Application Data

[63] Continuation-in-part of Ser. No. 613,292, Nov. 15, 1990, which is a continuation-in-part of Ser. No. 473,348, Feb. 1, 1990, which is a continuation-in-part of Ser. No. 381,014, Jul. 17, 1989.

[51] Int. Cl.[5] ..... A47L 11/36

[52] U.S. Cl. ..... 15/98; 15/246; 15/78; 15/229.3; 15/49.1; 15/147.1

[58] Field of Search ..... 15/229.3, 229.4, 246, 15/49.1, 50.1, 83, 78, 98

[56] References Cited

U.S. PATENT DOCUMENTS

| | | | |
|---|---|---|---|
| 941,306 | 11/1909 | Burnside | 15/246 |
| 1,695,246 | 12/1928 | Gammeter | 15/246 |
| 2,079,367 | 5/1937 | Tringa | 15/246 |
| 2,756,453 | 7/1956 | Mattson | 15/246 |
| 2,851,717 | 9/1958 | Kasper | 15/246 |
| 4,989,288 | 2/1991 | Moore | 15/78 X |

*Primary Examiner*—Paul T. Sewell
*Assistant Examiner*—Beth Anne Cicconi
*Attorney, Agent, or Firm*—James B. Middleton

[57] ABSTRACT

A bumper is fixed to the frame of a dust mop so the bumper will engage stationary objects and prevent damage to the mop head on the mop frame. Dust mops are generally carried under a carrier, and the bumper is primarily needed only on the portion of the mop that extends from under the carrier; and, the bumper extends beyond the mop frame to protect the complete mop when the mop is run at an angle with respect to the direction of motion. Bumpers can be provided on each end of a mop frame. For the short reversible frame, the bumpers will be on opposite sides; for long nonreversible frames, the bumpers will be on the same side. A new mop head is attachable to the mop frame around the bumpers by having a plurality of flaps making up the top. The flaps can be fastened around the frame with the bumper in place on the frame.

11 Claims, 2 Drawing Sheets

10
11
11
12
14
15
15
16
16
18
18
19
19
19'
20
20
20'
21
22
24
25

DUST MOP WITH BUMPER

CROSS-REFERENCE TO RELATED APPLICATIONS

This application is a continuation in part of the application by the same inventor filed Nov. 15, 1990, having Ser. No. 613,292, which is a continuation-in-part of the application Ser. No. 473,348, filed Feb. 1, 1990, which is in turn a continuation-in-part of application Ser. No. 381,014, filed Jul. 17, 1989.

INFORMATION DISCLOSURE STATEMENT

The basic dust mop is old and well known in the art, and the basic dust mops have been used successfully for many years. More recently, the conventional dust mops have been mounted on industrial trucks to be moved through a warehouse or the like. The above identified parent applications disclose apparatus whereby generally conventional dust mops are carried by an industrial truck and passed through a warehouse to sweep and dust the warehouse. Such apparatus, though rather new, has met with considerable success.

Dust mops carried by an industrial truck are highly beneficial in that the well-known and very effective dust mops are used at high speed to sweep and dust a large floor in a short period of time. Those skilled in the art will realize that, when sweeping a warehouse, one is likely to cause a dust mop to engage a solid obstacle. Such encounters were anticipated in the above identified applications of the same inventor, the mops being spring-urged to maintain the desired position with respect to the direction of travel. The resilient positioning of the mop was to allow the mop to be hit and moved from its intended position, and automatically to return to its intended position.

It has been found that the dust mops disclosed in the above identified applications do in fact move when they strike an object, and do in fact return to the intended position. It has also been found, however, that, where the mop strikes an object, the mop is damaged. As a result, a mop head has a shorter useful life than is normally expected.

SUMMARY OF THE INVENTION

This invention relates generally to dust mops and the like, and is more particularly concerned with a bumper for dust mops, the bumper being on the frame to protect the mop head when the dust mop strikes an obstacle.

The present invention provides a bumper for a dust mop, the bumper being located forwardly of the dust mop and extending through a sufficient portion of the length of the dust mop to prevent the mop head from engaging stationary objects. The bumper of the present invention is carried by the mop frame; and, in the preferred embodiment of the invention, the bumper remains in place, and a mop head can be selectively installed on the mop frame. The mop head of the present invention is altered to allow the mop head to be attached to the frame without interference from the bumper.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figures 1, 2, 3:
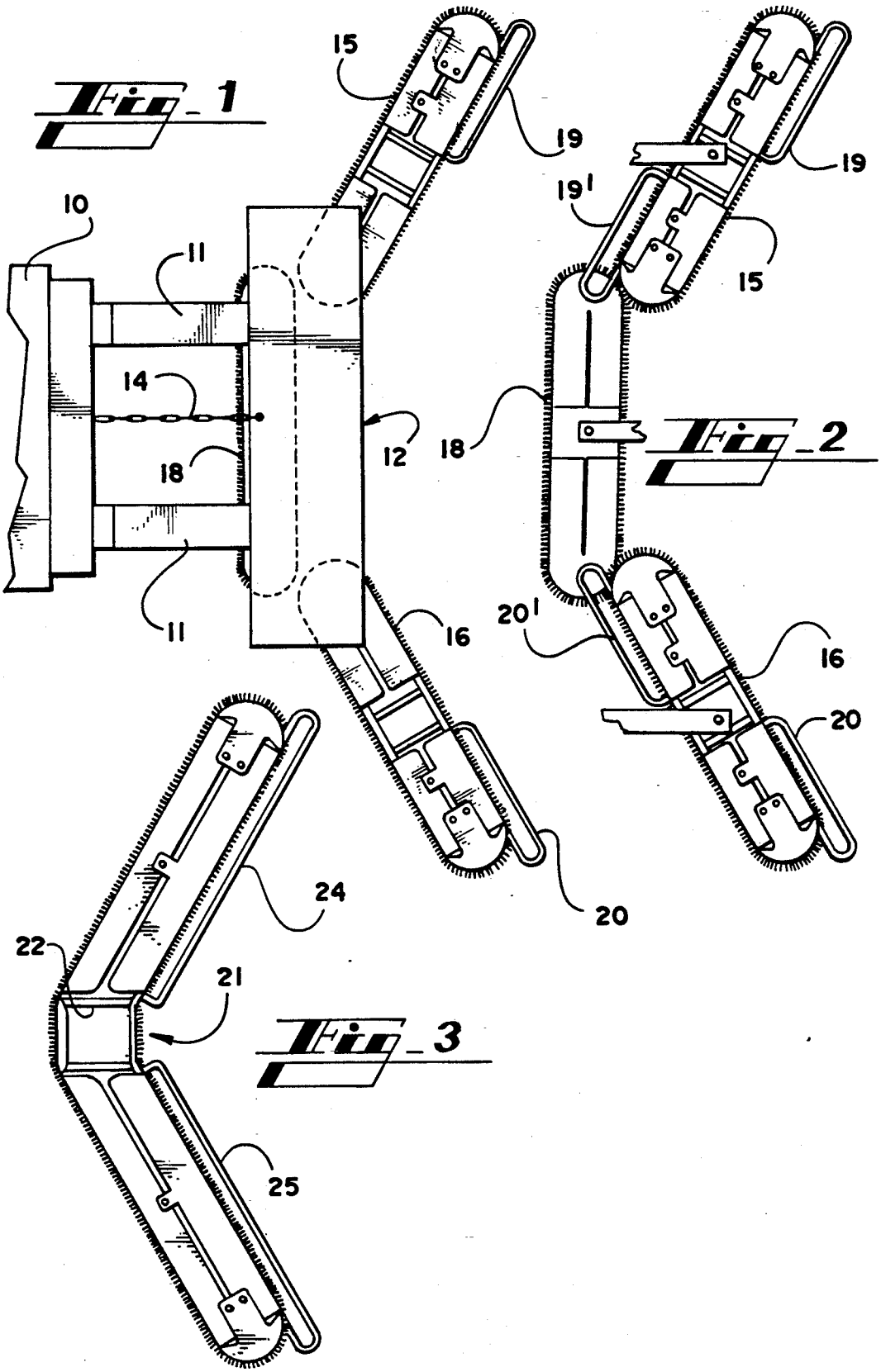
FIG. 1 is a top plan view of an apparatus for carrying a plurality of dust mops on an industrial truck, the dust mops having bumpers made in accordance with the present invention.
FIG. 2 is a view similar to FIG. 1, but with the carrier broken away to show the arrangement of the dust mops.
FIG. 3 is a view similar to FIG. 2, but showing a modified form of mop frame.

Referring now more particularly to the drawings, and to those embodiments of the invention here presented by way of illustration, FIG. 1 shows an industrial truck 10 having forks 11 which mount a carrier 12. The carrier 12 is secured to the industrial truck 10 by a chain 14 to prevent the carrier 12 from sliding off the ends of the forks 11.

The carrier 12 has a plurality of dust mops suspended therebelow. The specific mechanical arrangement for mounting the mops is disclosed in the above identified parent applications. That arrangement is not a part of the present invention, so no detailed disclosure is included in this application. It will be understood, however, that there are three dust mops designated at 15, 16 and 18. The mops 15 and 16 are at the lateral extremities, and direct the collected debris towards the center mop 18. Because of this arrangement, it will be understood that only the mops 15 and 16 may engage a stationary object, and only these mops require a bumper in accordance with the present invention. Furthermore, looking at FIG. 1 of the drawings, it will be readily seen that only the portions of the mops 15 and 16 which extend beyond the carrier 12 are likely to encounter a stationary object. The bumpers 19 and 20 on the mops 15 and 16 respectively are therefore limited in length to approximately the portion of the mops extending beyond the carrier 12.

Attention is next directed to FIG. 2 of the drawings for a further discussion of the bumper of the present invention. Here it will be noted that each of the mops 15 and 16 includes two bumpers, the mop 15 having bumpers 19 and 19', and the mop 16 having bumpers 20 and 20'. Only one of the bumpers, such as the bumpers 19 and 19', is actively utilized at one time; but, it is customary to reverse the dust mops at will, and the presence of bumpers on both ends allows the reversal while retaining the advantages of the bumpers.

With further attention to FIG. 2 of the drawings, it will be realized that the mop frames with the bumpers of the present invention must be made as right-hand and left-hand mop frames. The mop 15 has the bumper 19 on the left, front end thereof, and the bumper 19' on the right, rear end thereof. The mop 16 has the bumper 20 on the right, front end, and the bumper 20' on the left, rear end. Each of the mops 15 and 16 can be rotated 180°, and the bumper arrangement will be the same, but the mops 15 and 16 cannot be interchanged.

The bumpers 19 and 20 extend beyond the end of the mops 15 and 16. Since the mops 15 and 16 are intended to be carried at an angle as shown, if the bumpers 19 and 20 extended only to the end of the mop frame, a portion of the mop would be exposed when the mop is angled.

Thus, the bumpers 19 and 20 extend for enough to offer full protection of the mops 15 and 16 when in use.

Looking now at FIG. 3 of the drawings, a modified form of mop is indicated at 21. This form of mop is disclosed in detail in the above identified application Ser. No. 613,292, and comprises a single mop to replace the three-mop arrangement shown in FIGS. 1 and 2.

In the mop 21, the frame 22 is shaped into a V shape, so the mop 21 is not intended to be reversed. Further, the single mop 21 spans the entire width to be swept. Thus, each end of the mop 21 requires a bumper, as indicated at 24 and 25. As before, the bumpers 24 and 25 extend beyond the ends of the mop frame 22 so the bumpers will protect the mop while disposed at an angle.

The mop 21 will depend from a carrier, like that shown in FIG. 1 of the drawings, and the bumpers 24 and 25 are truly needed only on the portions of the frame 22 that extend beyond the carrier. The bumpers 24 and 25 are longer than may be needed, but are arranged to allow the same design of mop head as is used on other mop frames. This will be better understood after the description of the mop head below.

Figure 4:
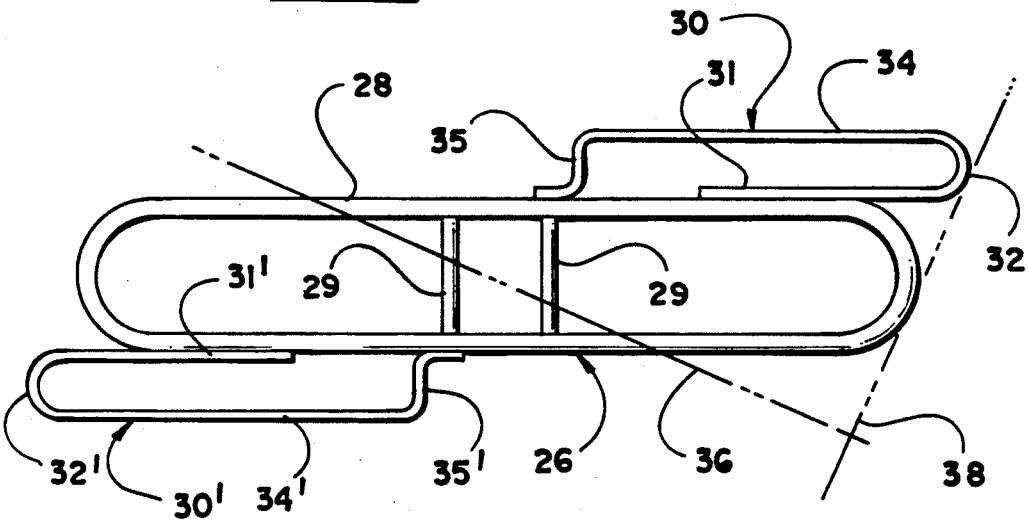
FIG. 4 is an enlarged, top plan view showing a mop frame like that shown in FIG. 2, without the mop head; and, FIG. 5 is a view similar to FIG. 4, but showing a mop head installed on the mop frame.

Attention is now directed to FIG. 4 of the drawings for a more detailed understanding of the mop frame and bumper of the present invention.

The mop frame is indicated at 26, and includes the oval frame 28 for supporting a mop head, and struts 29 by which the frame 26 is mounted to a carrier. This construction is shown in the parent applications identified above. The bumper 30 has a rear member 31 fixed to the frame 28 by welding or the like. The rear member 31 is integral with a curved end 32 which is connected to a front member 34. The front member 34 extends the desired distance along the frame 28, and terminates in a connector 35 which fixes the front member 34 to the frame 28.

The mop frame 26 includes a second bumper 30' which is formed precisely like the bumper 30; therefore, the bumper 30' will not be described in detail, but the primes of the same reference numerals for the bumper 30 are applied to like parts of the bumper 30'.

In FIG. 4 there is a centerline designated at 36. This centerline is intended to indicate a line transverse to the direction of movement of a sweeper such as that shown in FIG. 1. If a line 38 is then drawn to be perpendicular to the centerlin 36, and tangent to the frame 28, this tangent line 38 will indicate the needed extension of the bumper 30. The line 38 ought therefore to be tangent to both the bumper 30 and the mop frame 26, and perpendicular to the centerline 36. With these guidelines, those skilled in the art will understand that considerable variation is possible, depending on the specific construction of the mop frames used.

Figure 5:
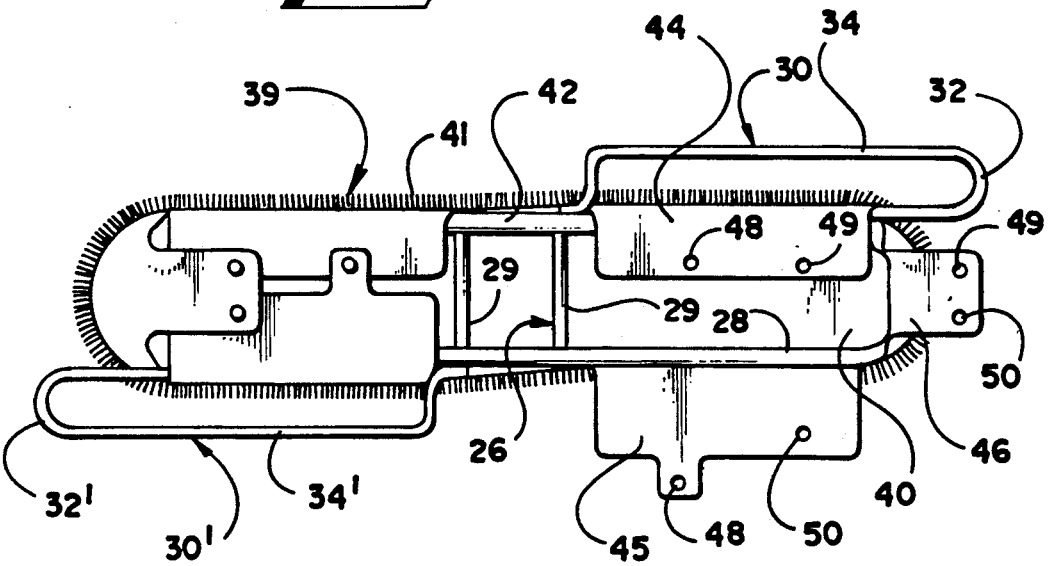

The conventional dust mop head is constructed to allow one side of the mop head to be slipped over the mop frame, then the other side is snapped or otherwise fastened in place. With the bumpers of the present invention fixed to the mop frame, the conventional mop head cannot be used. One preferred form of mop head is shown in FIG. 5 of the drawings. The frame of FIG. 4 is the same as the mop frame in FIG. 5, so the same reference numerals are used in FIG. 5.

The mop head in FIG. 5 is generally designated at 39. The mop head 39 will be constructed generally the same as conventional mop heads in that there will be a base member 40 having yarns, or strings, 41 extending therefrom to make up the dusting surface. This is well known to those skilled in the art, and no further description is thought to be necessary.

The novel portion of the present mop head 39 is the top, which secures the mop head to the mop frame. Due to the presence of the bumpers 30 and 30', the usual arrangement cannot be used; therefore, the mop head 39 has a top comprising a plurality of flaps for securing the mop head to the mop frame.

The center of the mop head is open, as at 42, to allow the struts 29 to be connected to the support arms of the carrier. Each end of the mop head then includes front and rear flaps 44 and 45 and an end flap 46. The left hand side of the mop head in FIG. 5 is secured around the frame 26, and the flaps are designated with the primes of the numerals used on the right hand side. Snaps are here shown to fix the flaps together, but of course other fastening means may be used as well.

The flap 44 is of a length to be received through the bumper 30, and fold over the base member 40. The opposed flap 45 is complementary to the flap 44, and can be fixed to the flap 44 by a snap 48. After the flaps 44 and 45 are snapped together, the end flap 46 can be folded over the base member 40, and snaps 49 and 50 will fix the flap 46 in place. The opening between the flap 44 and the flap 46 allows the rear member 31 of the bumper 30 to extend outwardly of the mop head. Again, the completed enclosure is shown on the left side of the mop head in FIG. 5.

With the above description in mind, it will be understood that the bumpers 24 and 25 in the embodiment of the invention shown in FIG. 3 could be made shorter by dividing the flaps 44 and 45 to provide openings for the connectors such as the connector 35. This is an obvious modification, but one that may not be economically advantageous.

The present invention therefore provides a bumper for a dust mop, the bumper serving to protect a mop head from damage when the mop engages a stationary object during use. The bumper is arranged to allow normal use of a dust mop, and simply reduces the damage to the mop head that may otherwise shorten the useful life of a mop head. The mop head of the present invention is easy to use with the mop frame of the present invention, and allows easy installation of a mop head on a mop frame.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. In the combination including a dust mop, a carrier supporting said dust mop for movement across a floor in a forward direction for sweeping a path, and a vehicle for mounting said carrier and moving said carrier across said floor in said path, the improvement comprising a bumper on said dust mop, said dust mop comprising a mop frame, and a mop head received on said mop frame, at least a portion of said mop frame extending laterally beyond said carrier to the periphery of said path, said bumper being fixed to said mop frame in front of said mop frame with respect to said forward direction and covering said at least a portion of said mop frame, the arrangement being such that stationary objects in said path at said periphery of said path will be engaged by said bumper rather than said mop head on said mop frame.

2. In the combination claimed in claim 1, wherein said mop frame comprises an oval frame for receiving said mop head, and central struts for attaching said dust mop to said carrier, said oval frame including a right side portion on the right hand side of said central struts, and a left side portion on the left hand side of said central struts, the improvement including a second bumper on said dust mop, said bumper being located on said right side portion, said second bumper being located on said left side portion and on the rear with respect to said forward direction, said mop frame being symmetrical so that said dust mop can be rotated to allow use of the opposite side of said dust mop.

3. In the combination claimed in claim 2, the further improvement wherein said bumper includes a front member forward of said oval frame, and means for fixing said front member with respect to said mop frame.

4. In the combination in claim 3, the improvement including a rear member fixed to said right side portion of said oval frame, and an end connecting said rear member to said front member, said end being located laterally beyond said right side portion of said oval frame.

5. In the combination as claimed in claim 4, the improvement including a connector for fixing said front member to said oval frame.

6. In the combination as claimed in claim 5, the further improvement wherein said mop head comprises a base sheet generally coextensive with said oval frame, a front flap fixed to said base sheet and extending through said bumper between said front member and said rear member, a complementary flap fixed to said base sheet and selectively fixable to said front flap, and an end flap fixed to said base sheet and selectively fixable to said front flap and said complementary flap, said rear member of said bumper extending between said front flap and said end flap.

7. In the combination claimed in claim 1, wherein said mop frame comprises an oval frame for receiving said mop head, and central struts for attaching said dust mop to said carrier, said oval frame including a right side portion on the right hand side of said central struts, and a left side portion on the left hand side of said central struts, the improvement including a second bumper on said dust mop, said bumper being located on said right side portion, said second bumper being located on said left side portion and on the front of said mop frame with respect to said forward direction, said right side portion and said left side portion being angled forwardly from said central struts.

8. In the combination claimed in claim 7, the further improvement wherein said bumper includes a front member forward of said oval frame, and means for fixing said front member with respect to said mop frame.

9. In the combination in claim 8, the improvement including a rear member fixed to said right side portion of said oval frame, and an end connecting said rear member to said front member, said end being located laterally beyond said right side portion of said oval frame.

10. In the combination as claimed in claim 9, the improvement including a connector for fixing said front member to said oval frame.

11. In the combination as claimed in claim 10, the further improvement wherein said mop head comprises a base sheet generally coextensive with said oval frame, a front flap fixed to said base sheet and extending through said bumper between said front member and said rear member, a complementary flap fixed to said base sheet and selectively fixable to said front flap, and an end flap fixed to said base sheet and selectively fixable to said front flap and said complementary flap, said rear member of said bumper extending between said front flap and said end flap.

* * * * *